US005344091A

United States Patent [19]

Molison

[11] Patent Number: 5,344,091

[45] Date of Patent: Sep. 6, 1994

[54] APPARATUS FOR WINDING STIFFENED CORELESS ROLLS AND METHOD

[75] Inventor: Robert E. Molison, Hanover, Pa.

[73] Assignee: Elsner Engineering Works, Inc., Hanover, Pa.

[21] Appl. No.: 110,122

[22] Filed: Aug. 20, 1993

[51] Int. Cl.[5] ..... B65H 35/08

[52] U.S. Cl. ..... 242/527.1; 242/DIG. 3; 242/535.1; 83/305; 83/349

[58] Field of Search ..... 242/56 R, 67.1 R, 67.2, 242/67.3 R, 65, 66, 68.5, DIG. 3; 83/91, 156, 305, 349; 270/58

[56] References Cited

U.S. PATENT DOCUMENTS

| | | | |
|---|---|---|---|
| 1,802,554 | 4/1931 | Hahn . | |
| 2,588,581 | 3/1952 | Sieger | 83/305 X |
| 2,642,937 | 6/1953 | Hallden | 164/49 |
| 2,642,938 | 6/1953 | Hallden | 164/68 |
| 2,843,202 | 7/1958 | Hallden | 164/49 |
| 3,013,367 | 12/1961 | LaSarre | 242/DIG. 3 |
| 3,390,762 | 7/1968 | Mernieks | 242/68.5 |
| 3,555,771 | 1/1971 | Mathes | 53/73 |
| 3,643,537 | 2/1972 | Fries | 83/305 |
| 3,750,510 | 8/1973 | Gabriels | 83/305 |
| 3,823,887 | 7/1974 | Gerstein | 242/56 |
| 3,856,226 | 12/1974 | Dowd | 242/56 |
| 3,898,900 | 8/1975 | Schmermund | 83/152 |
| 3,899,075 | 8/1975 | Hall et al. | 242/68.5 X |
| 4,058,041 | 11/1977 | Ito | 83/305 |
| 4,093,141 | 6/1978 | Garrett, Sr. et al. | 242/78.1 X |
| 4,159,661 | 7/1979 | Russell et al. | 83/305 |
| 4,218,943 | 8/1980 | Osburg | 83/304 |
| 4,258,846 | 3/1981 | Campo | 206/412 |
| 4,294,145 | 10/1981 | Bodewein | 83/302 |
| 4,570,917 | 2/1986 | Marass | 270/53 |
| 4,651,605 | 3/1987 | Dean | 83/209 |
| 4,695,005 | 9/1987 | Gietman | 242/56 |
| 4,807,825 | 2/1989 | Elsner et al. | 242/56 |
| 5,207,138 | 5/1993 | Sato et al. | 83/337 |
| 5,211,383 | 5/1993 | Valentinis | 270/58 X |

*Primary Examiner*—Daniel P. Stodola
*Assistant Examiner*—John P. Darling
*Attorney, Agent, or Firm*—Thomas Hooker

[57] ABSTRACT

An apparatus and method for winding stiffened coreless rolls which include a spiral wound roll formed from this product paper, conventionally paper having a printed pattern or design on one side, and a spiral stiffener sheet extending completely around the roll to stiffen the roll. The apparatus receives continuous webs of product paper and stiffening paper, severs the stiffening paper into short lengths for winding into the roll of product paper and automatically feeds the stiffening sheet onto a length of product paper which is wound into a roll. The two webs are fed to either side of a continuous rotating cutter roll. Anvil assemblies are moved into engagement with a knife carried on the cutter roll for selectively severing the webs as required.

33 Claims, 7 Drawing Sheets

APPARATUS FOR WINDING STIFFENED CORELESS ROLLS AND METHOD

FIELD OF THE INVENTION

The invention relates to apparatus and methods for cutting webs of paper and for winding spiral rolls from lengths of paper.

DESCRIPTION OF THE PRIOR ART

Conventional roll winding machines wind coreless rolls of product paper by feeding a web of paper along a path, winding the lead end of the web into a roll at a web rolling assembly, severing the web and discharging the completed roll from the machine. A machine of this type is shown in U.S. Pat. No. 4,807,825. This machine rapidly manufactures coreless rolls from product paper, typically wrapping paper of the type used to wrap birthday and holiday gifts and other packages.

Coreless rolls may be wound from relatively short lengths of product paper or from relatively long lengths of product paper. Rolls wound from longer lengths of product paper are relatively stiff, because of their wall thickness, and resist dents or flattening better than rolls wound from shorter lengths of product paper. Shorter length rolls are relatively flimsy and are easily dented or flattened. This is a serious problem because the rolls are manufactured at a site and must be transported without damage to a retail site where the rolls are displayed for customer purchase. The rolls are easily dented or flattened during shipment, rendering the rolls unsuitable for consumers.

It is conventional to stiffen rolls of product paper by winding the length of paper around a preformed cardboard core. The core effectively strengthens the roll but has a number of disadvantages. Because cores are large, light, and expensive to transport, cores are conventionally manufactured from paper and glue at the site where the rolls are wound. Core manufacture is expensive and requires considerable space on the shop floor for the material used in making the cores, the core making equipment and the inventory of cores required for the winding of cored rolls. In fact, the total cost of a glued paper core for a roll of wrapping paper may amount to as much as 75 percent of the total manufactured cost of the core and roll.

SUMMARY OF THE INVENTION

The disclosed apparatus for winding stiffened coreless rolls receives a first continuous web of product paper which is wound into a coreless roll and a continuous web of relatively stiff paper which is automatically cut into segments. The segments are fed, one at a time, onto the lead portions of the segments of product paper being wound into rolls. The segments are wound into the initial inner spirals of the rolls with the product paper. The segments extend around the roll more than 360 degrees to provide a stiff continuous internal spiral layer within the roll. The layer strengthens the roll to prevent ready bending or collapse of the roll.

The two webs are fed into the apparatus to either side of a continuously rotating cutter roll carrying a single cutter knife. Anvil web assemblies are located on either side of the cutter roll outside of the webs and are actuated selectively to move anvils toward the knife at appropriate times to sever the product paper web and the stiffening paper web. The product paper web is rotated by downstream movement of the rotary knife in the direction of continuous movement of the product paper of the web. The stiffening paper web is dwelled and then cut by movement of the knife in an upstream direction, that is in a direction opposite the direction of movement of the web after cutting. The severed segments of the stiffening paper are automatically fed onto the product paper web for winding into the stiffened roll.

The roll making apparatus automatically and rapidly winds coreless rolls at a high production rate in which the product paper may be fed through the machine at speeds as great as about 600 feet per minute. Depending upon the length of product paper wound in each coreless roll, as many as 50 or 60 rolls may be formed each minute. The rolls are rotated out of the machine and are packaged or banded in a conventional manner.

The disclosed apparatus rapidly and efficiently manufactures stiffened coreless rolls from web material supplied directly from supply rolls. Strengthened rolls are formed from short lengths of stiffened paper with marked reduction in cost over the cost of forming cored rolls. The apparatus requires considerably less floor space than a a conventional equipment required to make cores and to wind product paper on the cores.

Other objects and features of the invention will become apparent as the description proceeds, especially when taken in conjunction with the accompanying drawings illustrating the invention, of which there are 7 sheets and one embodiment.

DESCRIPTION OF THE DRAWINGS

FIGS. 2 through 5 are views similar to FIG. 1 illustrating the position of the apparatus during the cycle of operation;

DESCRIPTION OF THE PREFERRED EMBODIMENT

Apparatus 10 rapidly and automatically winds stiffened coreless rolls 12 each including an elongate spiral wound length of product paper 14 and a short spiral wound length of stiffening paper 18 wound with the product paper. The product paper 14 is typically conventionally printed or patterned wrapping paper of the type used to wrap Christmas presents, birthday presents and the like. This paper is thin and without great strength when relatively short lengths are spiral wound into rolls.

Figure 8:
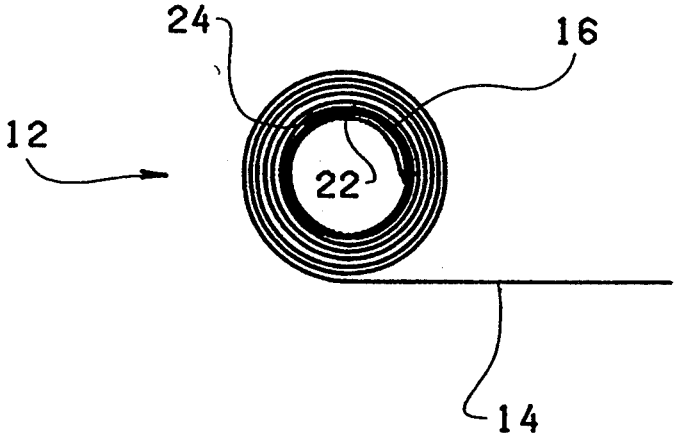
FIG. 8 is an end view of a partially wound stiffened roll.

A short length 20 of stiffener paper 18 is wound into the initial inner spirals of roll 12 as indicated in FIG. 8. The stiffener paper 20 is sufficiently long so that the lead and trailing ends 22 and 24 of the length of stiffening paper overlap each other and the stiffening paper extends completely around the roll to stiffen the roll materially and prevent ready denting or bending of the roll. The resultant wound roll 12 has a strength comparable to the strength of a roll of the product paper wound around a preformed glued paper core without the necessity or expense of providing a separate core.

Figure 7:
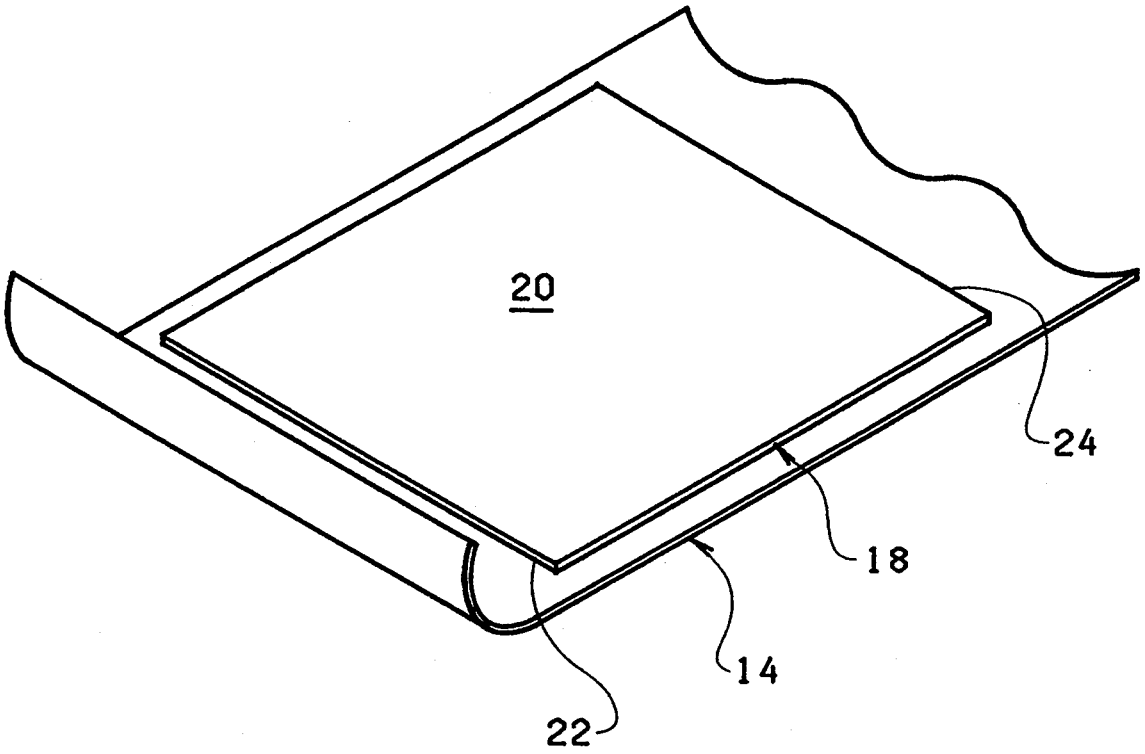
FIG. 7 is a perspective view of a portion of two webs which are wound to form a stiffened coreless roll.

FIG. 7 illustrates that the stiffening paper 18 may have a width slightly less than the width of product paper 14. Alternatively, the width of the stiffening paper may be equal to or greater than the width of the product paper, dependent upon the requirements of the particular roll wound by apparatus 10.

Apparatus 10 is related to the apparatus disclosed in Elsner and Molison U.S. Pat. No. 4,807,825 for "Roll Winding Machine", the disclosure of which is incorporated herein by reference. U.S. Pat. No. 4,807,825 is assigned to the assignee of the present invention.

Figure 1:
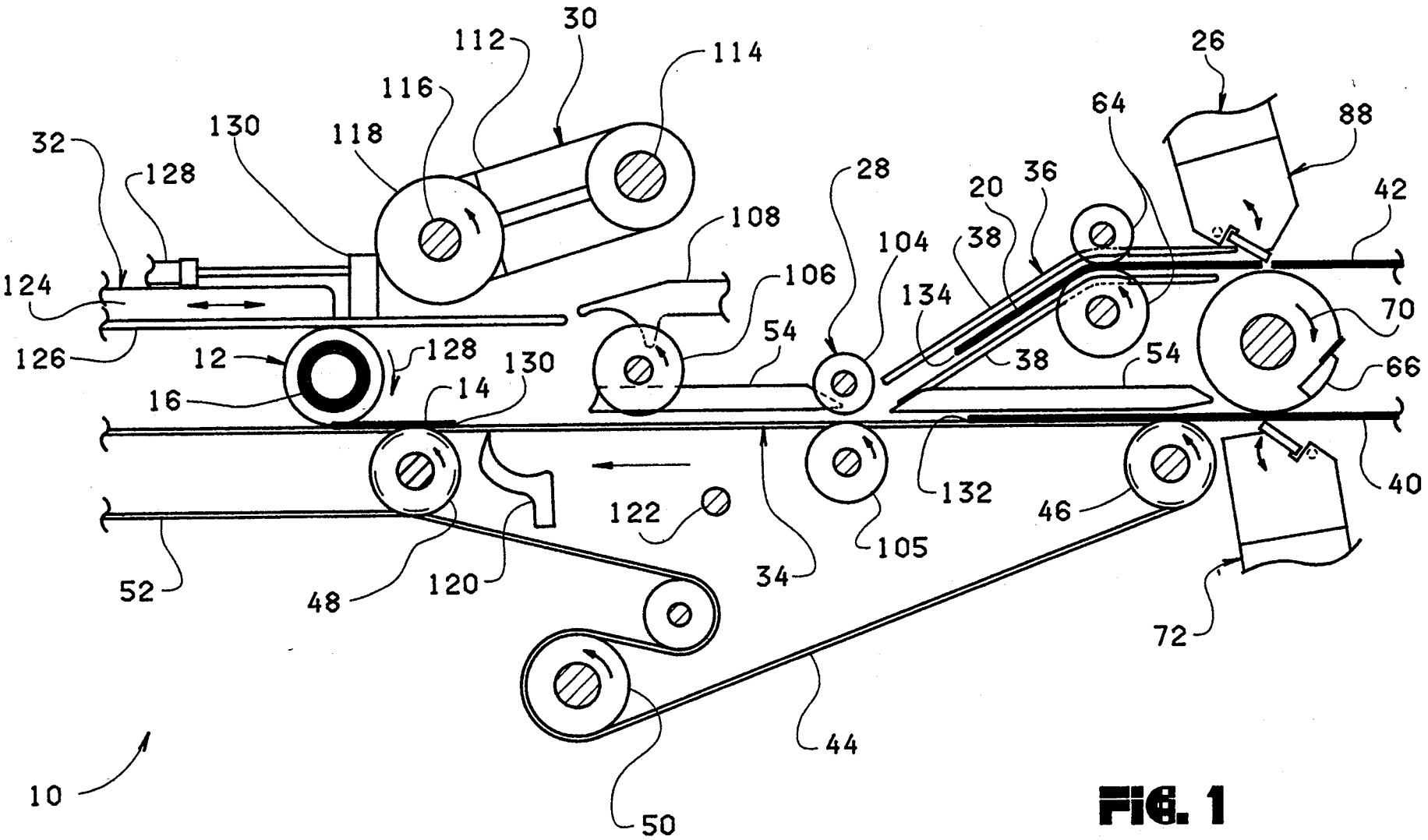
FIG. 1 is a vertical sectional view taken through the apparatus illustrating the start position of a roll winding cycle.

The apparatus 10 includes a frame (not illustrated) like the frame of the apparatus shown in the '825 patent. As shown in FIG. 1, web cutting assembly 26, stiffening paper feeding assembly 28, web winding assembly 30 and roll discharge assembly 32 are spaced along the length of product paper feed path 34 extending from the right end to the left end of machine 10. The broken away portion of the roll discharge assembly 32 to the left of FIG. 1 is identical to the roll discharge assembly of the apparatus shown in U.S. Pat. No. 4,807,825. The frame of apparatus 10 defines path side walls on either side of the product paper feed path 34 and the stiffening paper feed path 36 located above the product paper feed path 34 at the right hand or upstream end of the apparatus. The illustrated and described assemblies and the drives are supported on the frame.

Feed path 36 angles down and joins feed path 34 at stiffening paper feed assembly 28. The feed path 36 is defined by opposed stiffening paper guides 38 as shown in FIG. 6. The guides are closely spaced to define path 36 for feeding the stiffened paper. The separation between the guides 38 shown in FIGS. 1–5 is greater than in apparatus 10 in order to facilitate description of the operation of the apparatus.

A web 40 of product paper is fed from a supply roll (not illustrated) to the right hand or upstream end of path 34 as shown in FIG. 6 and a web of stiffening paper 42 is fed from a supply roll (not illustrated) to the right hand or upstream end of stiffening paper feed path 36.

Path 34 is partially defined by the upper horizontal runs of a plurality of feed belts 44 spaced across the width of the path. As illustrated, belts 44 are wrapped around upstream roller 46, spaced downstream rollers 48 and drive roller 50 located below the path. A suitable drive (not illustrated) rotates roller 50 to move the belts 44 downstream along path 34 at a continuous high speed, which may be as great as 1,200 feet per minute. A plurality of discharge belts 52 are spaced across the width of path 34 and wrapped around individual rollers spaced between rollers 48 so that the upper runs of belts 52 form a downstream continuation of feed path 34. A suitable drive moves belts 52 downstream along path 34 to facilitate downstream removal of partially wound rolls 12 from the winding assembly 30.

Hold down plates 54 extend across path 34 to either side of the assembly 28. Loose hold down balls shown in FIG. 6 are supported in plates 54 and rest on product paper web 40 and the lengths of stiffening paper 20 moving down path 34 to hold them in against belts 44. The hold down plates and weight balls are more fully described in U.S. Pat. No. 4,807,825.

The upstream end of apparatus 10, as illustrated in FIG. 6, includes a pair of product web drive rolls 56 located upstream of path 34 and a short pair of spaced web guides 58 located between rolls 56 and the cutting assembly 26. Rolls 56 and guides 58 define the upstream end of path 34. Rolls 56 rotate at a circumferential speed less than the downstream speed of belts 44 and control the speed at which web 40 moves downstream over the belts. The belts run past the web until a length of product paper is completely broken away from the web and is accelerated downstream by belts 44.

A first pair of stiffening paper feed rolls 60 is located upstream of the end of stiffening paper feed path 36. Upper paper guide 62 is located between the rolls and the web cutting assembly 26 above web 42. A movable paper guide 63 is located under the web and movable between extended and retracted positions as shown in solid and dotted lines. Rolls 60 and guides 62 and 63 define the upstream end of path 36.

Product paper web 40 extends between rolls 56 past the web cutting assembly 26 and along path 34 between belts 44 and hold down plates 54. Stiffening paper web 42 is fed between rolls 60 which are rotated to move the web downstream past paper guides 62 and 63, web cutting assembly 26, and into guides 38 and thence to assembly 28 where severed lengths of stiffening paper are fed onto path 34. A second pair of stiffening paper feed drive rolls 64 extend through openings formed in paper guides 38 adjacent the web cutting assembly 26 and engage the web 42.

Rolls 60 are located upstream of the cutting assembly 26 and rolls 64 are located downstream of the cutting assembly. Rolls 60 are connected to a drive for selective rotation at a circumferential speed less than the speed at which web 40 moves along path 34. Rolls 64 are selectively connected to a drive which rotates the rolls at a circumferential speed equal to the speed at which web 40 moves along path 34.

The web cutting assembly 26 includes an elongate cutter roll 66 mounted on a shaft journalled in bearings mounted on the frame of apparatus 10 to either side of path 34. The roll is located above and extends across paths 34 and 36 between webs 40 and 42. The cutter roll carries a helical knife 68 which extends along the length of the roll and is wrapped circumferentially around the roll. A drive rotates roll 66 in a clockwise direction as indicated by arrow 70 shown in FIG. 6 at a circumferential speed equal to the speed at which web 40 moves along path 34.

Rotation of roll 66 moves knife 68 past adjacent web 40 in the direction of downstream movement of the web and past adjacent web 42 upstream relative to the direction of movement of the web along path 36.

Product web anvil assembly 72 is located immediately below cutter roll 66 with web 40 extending between the roll and the anvil assembly. Assembly 72 includes anvil support 74 located under web 40 and extending across the width of the path 34. The support is rotatably mounted on the frame of apparatus 10 for rotation back and forth above pivot 76. Curved anvil blade 78 is attached to support 74. The support and blade are rotated about pivot 76 by extension and retraction of air cylinder 80 mounted on the frame of apparatus 10 at pin 82. The anvil support 74 includes a stop member 84 which is engagable with fixed stop member 86 secured to the frame of apparatus 10 when cylinder 80 is extended as shown in FIG. 6. In this position, anvil blade 78 is extended against the lower side of web 40 so that rotation of cutter roll 66 moves knife 68 past blade 78 to form a perpendicular shear cut across the width of moving product web 40. The anvil blade 78 is curved downstream in order to assure a perpendicular cut.

A number of openings or spaces are formed in the cutting edge of anvil blade 78 to provide a small number of continuous tabs holding the ends of the web 40 together at the cut despite the transverse cut formed by the anvil blade and knife. The tabs assure accurate continued high speed feeding of web 40 along path 34 by rolls 56 despite the cut formed by the knife and anvil blade.

Retraction of cylinder 80 rotates the anvil assembly 72 counterclockwise as shown in FIG. 1 to withdraw the anvil blade 78 below web 40.

Stiffening web anvil assembly 88 is located above cutter roll 66 with stiffening paper web 42 extending between the cutter roll and the assembly. Assembly 88 is similar to assembly 72 and includes an anvil support 90 extending across web 42 connected to the frame of apparatus 10 at pivot 92 to permit rotational movement as illustrated. Straight anvil blade 94 is secured to support 90 and includes a cutting edge which extends perpendicularly across the width of stiffener web 42. The anvil support and blade are rotated between extended and retracted positions by an air cylinder 96 which is connected to the frame of the apparatus at pin 98. When the cylinder is extended, as shown in FIG. 6, the blade 94 is moved away from web 42 and stop block 100 on the anvil support is spaced from fixed stop block 102 on the apparatus frame. Retraction of the cylinder 96 moves the assembly 88 to the position of FIG. 4 where blade 94 engages stationary web 42 and rotation of cutter roll 66 moves the helical knife 68 into engagement with the edge of blade 94 to form a perpendicular cut completely severing web 42. After the cut has been completed, cylinder 96 is extended to return the assembly to the position of FIG. 6 and retract blade 94 away from the web.

Web 42 extends between feed rolls 60, under fixed upper paper guide 62 and over movable lower paper guide 63, between assembly 88 and cutter roll 66 and between the two stiffening paper guides 38. Paper guide 63 is connected to the piston rod of cylinder 96 by a mechanical drive (not illustrated) so that when the cylinder 96 is extended as in FIG. 6 and cutter blade 94 is retracted away from web 42 the movable guide 63 is extended into the space between the assembly 88 and cutter roll 66 and engages the adjacent end of the lower paper guide 38 to assure continuous feeding of the new lead end of the completely severed web 42 between guides 38. Retraction of cylinder 96 to rotate the anvil assembly 88 to the position of FIG. 4 with stop 100 engaging stop 102 and anvil blade 94 positioned adjacent web 42 for cutting retracts the movable guide 63 from between the assembly and the cutter roll to a position as shown in dotted lines in FIG. 6 beneath fixed paper guide 62. In this position, the movable guide 63 is out of the path of the helical knife 68 and does not interfere with cutting of web 42.

Stiffening paper feed assembly 28 comprises a pair of closely spaced rolls 104 and 105 lying on opposite sides of path 36 for feeding lengths of stiffening paper 18 on path 36 downstream along the path 34 on top of web 40. A suitable drive rotates roll 105 at a circumferential speed equal to the feed speed product paper along the path 34.

Figure 2:
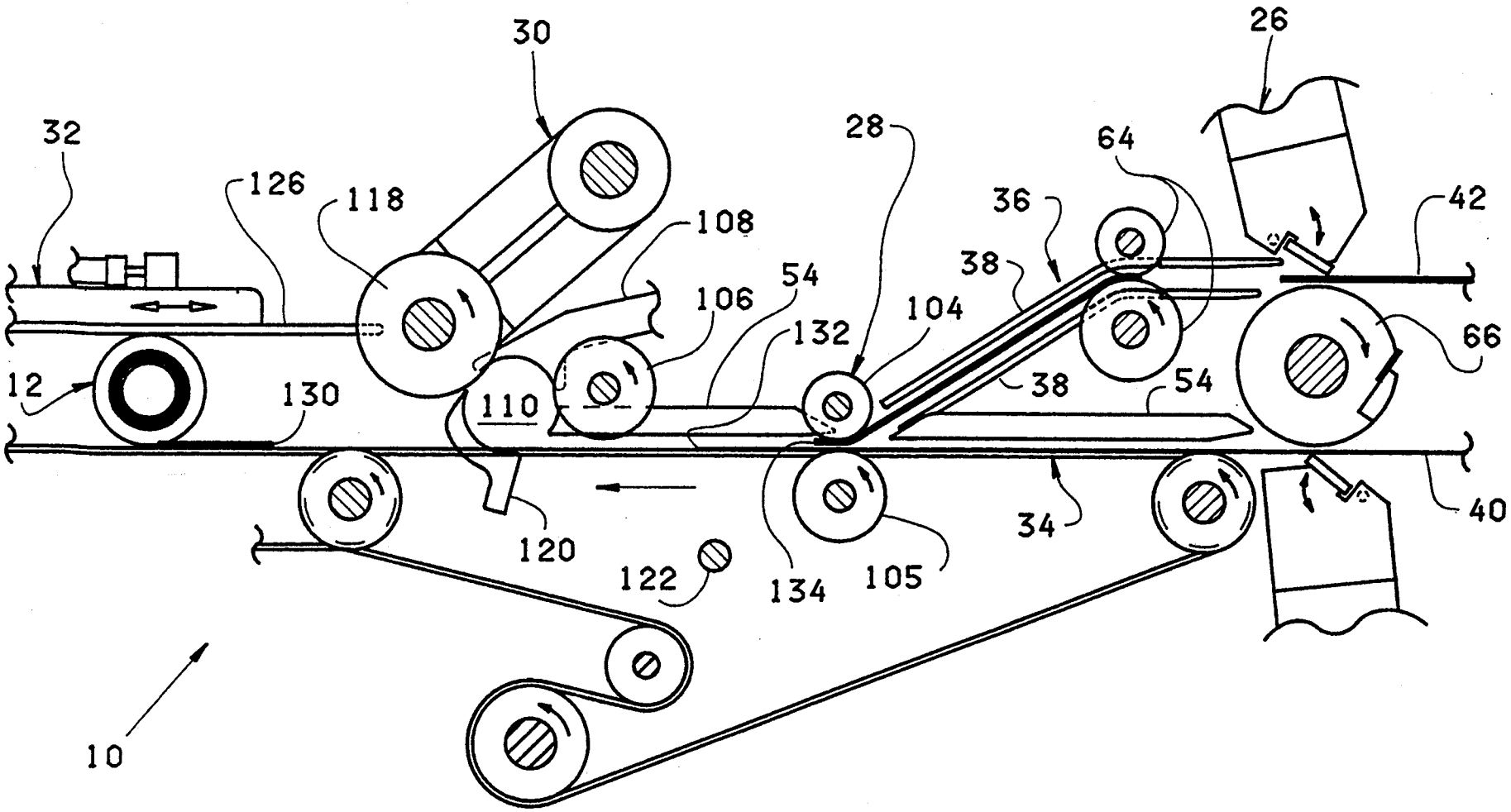

Web rolling assembly 30 receives the lead end of product paper length 14, with a sheet 18 positioned as shown in FIG. 7, as the length 14 is fed downstream along path 34 and winds the length and sheet into a stiffened coreless roll. The rolling assembly 30 operates like the rolling assembly of U.S. Pat. No. 4,807,825. Rolling assembly 30 includes a number of spaced apart rolls 106 extending across path 34 on the upstream side of the assembly. Rolls 106 are mounted on a shaft journalled in bearings on opposite sides of path 34 and are rotated in a clockwise direction as shown in FIG. 1 at a circumferential speed equal to the speed at which paper is fed downstream along the path. A set of spaced upper guide fingers 108 is located above rolls 106 with individual fingers extending between the rolls. The fingers are moved from a withdrawn position shown in FIG. 1 to a closed position as shown in FIG. 2 where the fingers define the top of web winding pocket 110. A pair of arms 112 are pivotedly mounted on shaft 114 extending across path 34 a distance above the path with a shaft 116 mounted in the ends of the arms and carrying a plurality of rolls 118 spaced across path 34. A suitable drive rotates rolls 118 in a counterclockwise direction as shown at FIG. 1 at a circumferential speed equal to the downstream speed of webs fed along path 34. Arms 112 are rotated to move the rolls 118 between a retracted position located above path 34 as shown in FIG. 1 and a lowered web rolling position located adjacent the path as shown in FIG. 2.

A plurality of spaced apart lower guide fingers 120 extend across path 34 between individual belts 44. The fingers 120 are mounted on shaft 122 by conventional connection (not illustrated) and rotate with the shaft. The shaft is rotated to move fingers 120 between a retracted position below path 34 as shown in FIG. 1 and an elevated web rolling position shown in FIG. 2 in which the fingers extend up between the individual belts 44 and form the downstream side of pocket 110.

FIG. 2 illustrates the web rolling assembly in the rolling position with fingers 120, rolls 118, fingers 108 and rolls 106 defining the cylindrical web winding pocket 110 extending across the width of path 34 for receiving the lead end of product paper length 14 and carrying length 20 of stiffening paper to be wound into a coreless stiffened spiral roll.

The roll discharge assembly 32 includes a support member 124 secured to the frame of apparatus 10 and located a distance above the upper runs of discharge belts 52. A plurality of spaced apart take away rails 126 are spaced apart across the width of path 34 and are movably mounted on support 124 for movement between an upstream extended position shown in FIG. 1 and a retracted position shown in FIG. 2. An air cylinder 128 is mounted on support 124 and includes a piston rod connected to block 130 joining rails 126. Extension of cylinder 128 moves the rails to the extended position and retraction of the air cylinder moves the rails to the retracted position.

The operation of apparatus 10 will now be described. The apparatus operates continuously through a repetitive cycle to wind stiffened coreless rolls in a production line basis at a rate which may be as great as 50 to 60 rolls per minute with web 40 moved downstream along path 34 to the web rolling assembly at a speed as great as 600 feet per minute. The machine is adjustable to determine the length of the product paper 14 wound into the roll and the length of the stiffening paper 18 wound into the roll. The stiffening paper is wound into the roll and has a circumferential extent greater than 360 degrees so that the ends of the stiffening paper overlap each other to form a spiral stiffening cylinder 16 extending completely around the roll. The stiffening cylinder formed by a length of stiffening paper 20 may be located at the inner portion of the roll, the center of the roll or the outer portion of the roll. Preferably, the stiffening paper layer is completely surrounded 360 degrees by the product paper in order to display the patterned product paper rather than the stiffening paper.

FIG. 1 illustrates the position of apparatus 10 after a coreless stiffened roll 12 has been partially wound in the web rolling assembly 30, the assembly has opened, cylinder 128 has extended take away rails 126 into the assembly and the partially wound coreless spiral roll 12 has moved downstream from the web rolling assembly by engagement with the upper runs of belts 44 and 52 moving downstream along path 34. The roll is captured between the extended takeaway rails 126 and the upper runs of the belts so that it is rotated downstream in a clockwise direction against the hold down rails as indicated by arrow 128 in FIG. 1. This rotation of the roll winds the upstream end of the length of product paper 14 onto the roll and, at the same time, breaks the narrow strips extending across the cut previously formed in the web 40 by knife 68 and anvil blade 78 and separates end 130 of product paper length 14 and the lead end 132 of web 40. Downstream rotation of the coreless roll 12 accelerates the downstream movement of the free end 130 of the product paper forming the roll away from the lead end 132 of web 40.

The roll 12 is rotated rapidly downstream from the upper runs of belts 44 which move the roll 12 downstream very rapidly and away from the web rolling assembly prior to forming the next roll. The rapid downstream movement of the roll 12 on belts 44 and then belts 52 move free end 130 beyond the rolling assembly prior to closing of the assembly. At this time web lead end 132 is upstream of the assembly. The belts 52 carry the fully wound roll downstream to a conventional banding or packaging station, as required.

In the position of FIG. 1, web 42 is cut at assembly 26. A stationary length 20 of stiffening paper is located between paper guides 38 a short distance from path 34. The web 42 and length 20 are stationary. The web extends upstream from the cut at assembly 26 past feed rolls 60. The lead end 132 of the product paper web 40 is located on path 34 a short distance upstream of roll 105 and is moved downstream by frictional or slip engagement with belts 44 at a rate controlled by the rotation of rolls 56. Cylinder 80 is retracted and cylinder 96 is extended so that the anvil blades 78 and 94 are pivoted away from webs 40 and 42, respectively.

In FIG. 2 the roll 12 has been rotated downstream along the upper runs of belts 52 a sufficient distance to move web end 130 beyond the web rolling assembly and cylinder 128 has been retracted to withdraw the take away rails 126 away from the web rolling assembly. With the cylinder retracted, the ends of the rails extend into the spaces between rolls 118 as illustrated. In this position, assembly 30 is closed to define the web winding pocket 110 with guide fingers 108 extended downstream of rolling head 106, arms 112 rotated down to position rolls 118 adjacent the ends of fingers 108 and fingers 120 rotated up through the spaces between adjacent belts 44 and into the path of downstream movement of web 40.

In FIG. 2 the upper runs of belts 44 and feed rolls 56 have moved web 40 downstream from the position of FIG. 1 with lead end 132 positioned under plate 54 between feed assembly 28 and closed rolling assembly 30. Feed rolls 64 have been rotated to feed the length of stiffening paper 20 along path 36 to position the lead end 134 of the length web 40 between drive feed roll 105 and idler feed roll 104. The thickness of paper 20 is sufficient to press the web 40 against the driven roll 105 and thereby move the length stiffening paper 20 downstream with web 40. Roll 105 is rotated in a downstream direction at the downstream speed of web 40. The lead end 134 of stiffening paper length 20 is located a short distance upstream from the lead end 132 of web 40.

At the same time, stiffening paper feed rolls 60 commence feeding the lead end of web 42 downstream between cutter roll 66 and stiffening web assembly 88 and between the upstream ends of paper guides 38. The web 42 is fed downstream at a rate slower than the rate at which web 40 is fed downstream along path 34. During operation of assembly 10 as shown in FIGS. 1 through 3, the anvil assemblies 72 and 88 are rotated away from cutter roll 66 to permit free movement of webs 40 and 42 past the roll and paper guide 63 is extended in the solid line position of FIG. 6.

FIG. 3 illustrates the position of apparatus 10 when the lead end 132 of web 40 is fed into the closed web winding pocket 110. Fingers 120 guide the end up from path 34. Engagement with rotating rolls 118, fingers 108 and rolls 106 ensure that the lead portion of web 40 and the overlying length of stiffening paper 20 are wound to a coreless partial spiral roll 12 shown in FIG. 8 with the portion 20 forming a circumferentially continuous spiral inner portion of the roll.

Continued downstream feeding of web 42 moves the lead end past the web cutting assembly 26, into the paper guides 38 and into engagement with rolls 64. The lower roll 64 is continuously driven at a circumferential rate equal to the feed rate along path 34. During feeding of web 42 by rolls 60, the driven lower roll 64 slips on the lower surface of the stiffening paper web. A sufficient length of stiffening paper is fed past the web cutting assembly for cutting the next length of stiffening paper 20. After feeding of the web 42, both rolls 60 and lower roll 64 are stopped so that the web 40 is stationary with the lead portion of the web positioned between guides 38 and the web extending continuously rearwardly from the guides past the web cutting assembly 26 and through stationary rolls 60.

Prior to forward feeding of web 42 cylinder 96 is extended and lower movable paper guide 63 engages the end of lower paper guide 38 to assure feeding of the lead end of web 42 between the guides 38. See FIG. 6.

Figure 4:
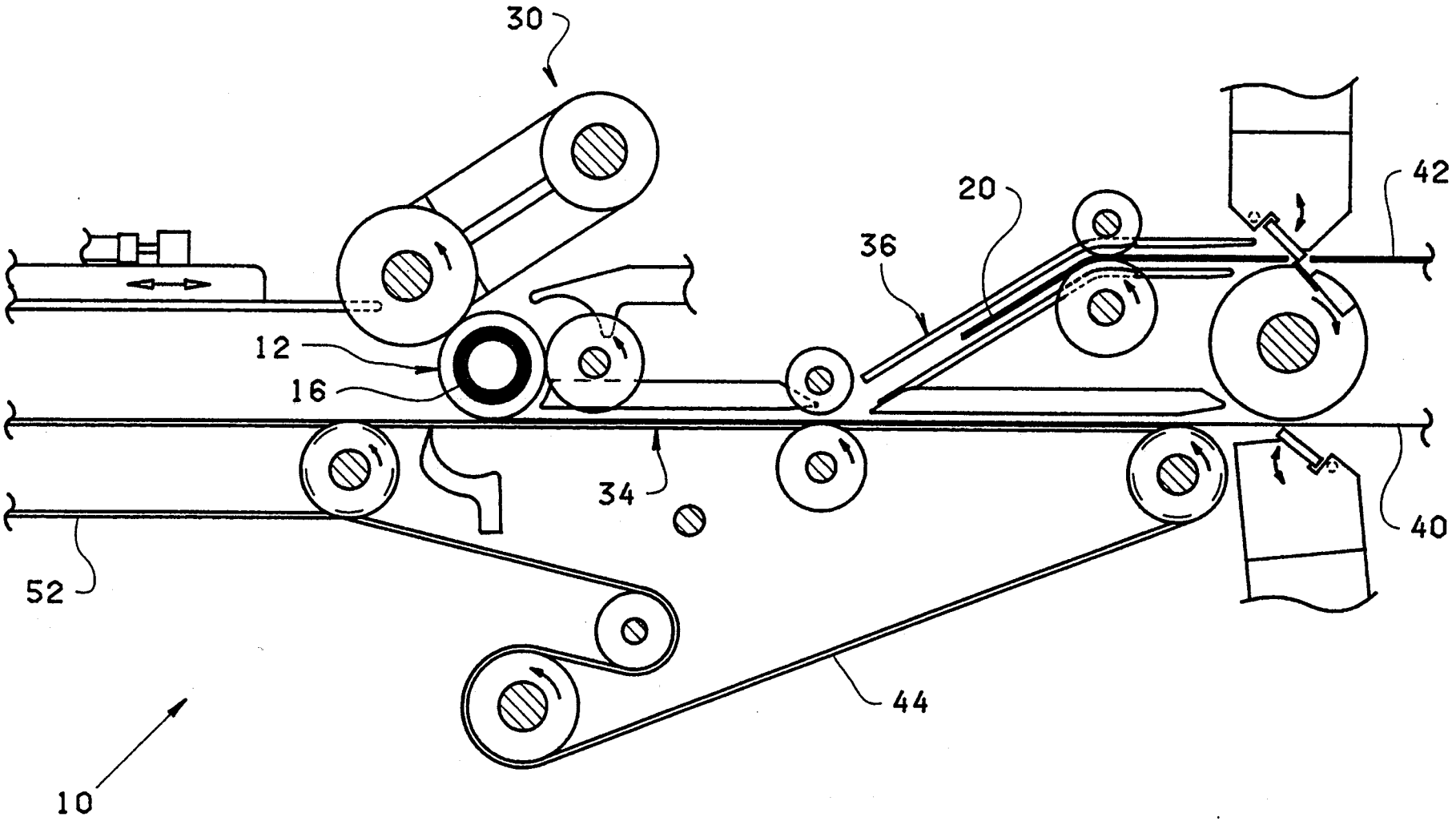
Figure 5:
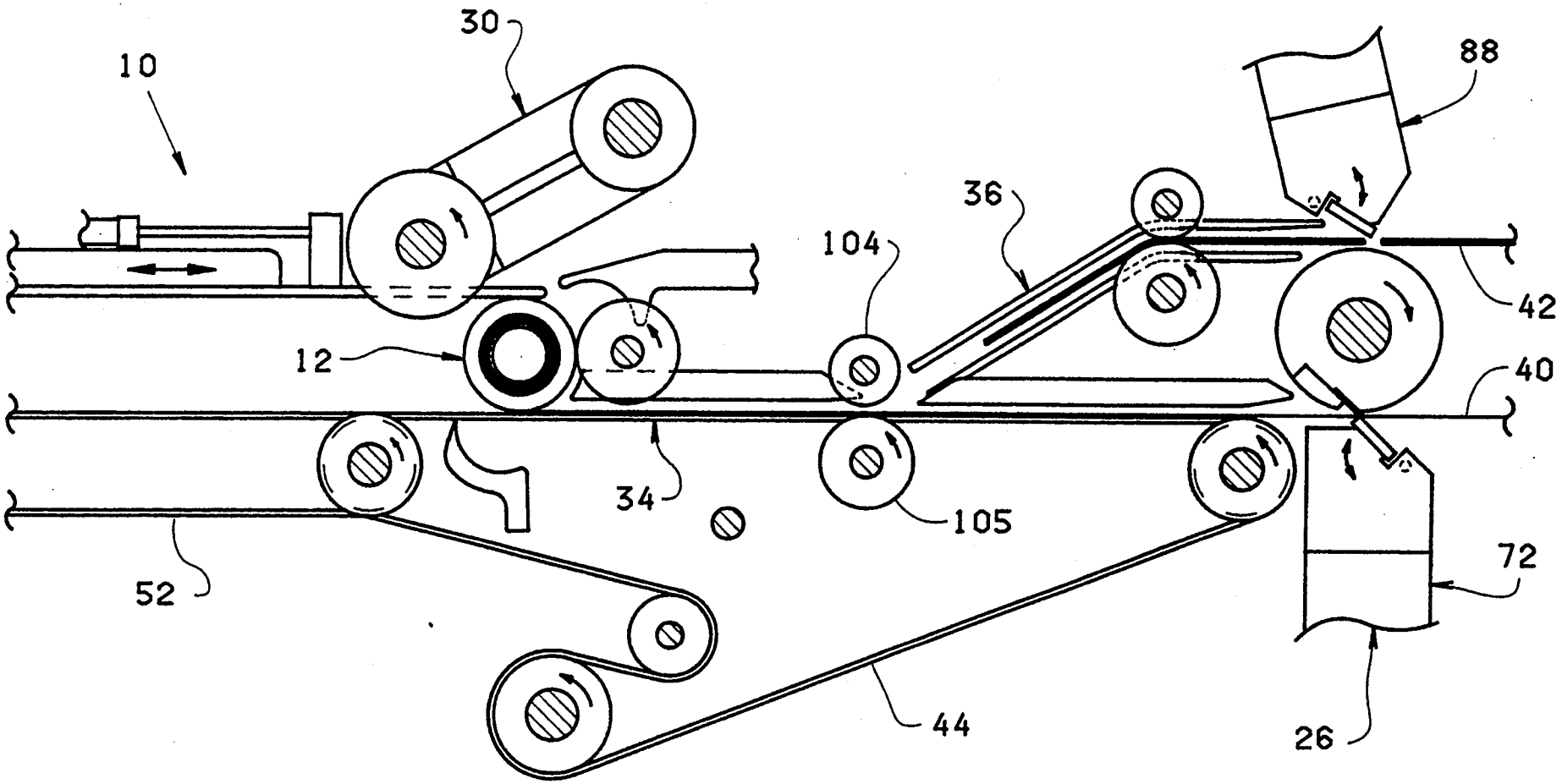

FIG. 4 illustrates the position of apparatus 10 with coreless spiral roll 12 held in assembly 30 and assembly 30 moving to the open position. Fingers 108 and 120 have been moved away from the pocket 110 and arms 112 are rotating upwardly away from the pocket. The stiffening paper is fully wound in the roll to form stiffening spiral 16. Web 40 extends continuously from feed rolls 56 to the roll 12, which is about to be released from the rolling assembly for downstream movement with web 40. Web 42 has been fully fed into the paper guides 38 defining path 36 and is stationary.

In this position, cylinder 96 is retracted to lower the anvil blade 94 toward web 42 so that the next rotation of roll 66 moves the cutting edge of helical knife 68 into engagement with the cutting edge of the straight anvil blade 94 to form a straight right angle cut extending across the width of the stationary stiffening paper web 42. The cut forms the next length of stiffening paper 20 to be wound into the next wound coreless roll. Retraction of cylinder 96 moves the lower guide plate 63 from the solid line position shown in FIG. 6 to the retracted dotted line position to permit cutting of the web 42. After web 42 is cut, cylinder 96 is re-extended to retract the anvil blade 94 and reposition the lower guide plate 63 to assure the new lead end of web 42 is guided into path 36.

Figure 5:
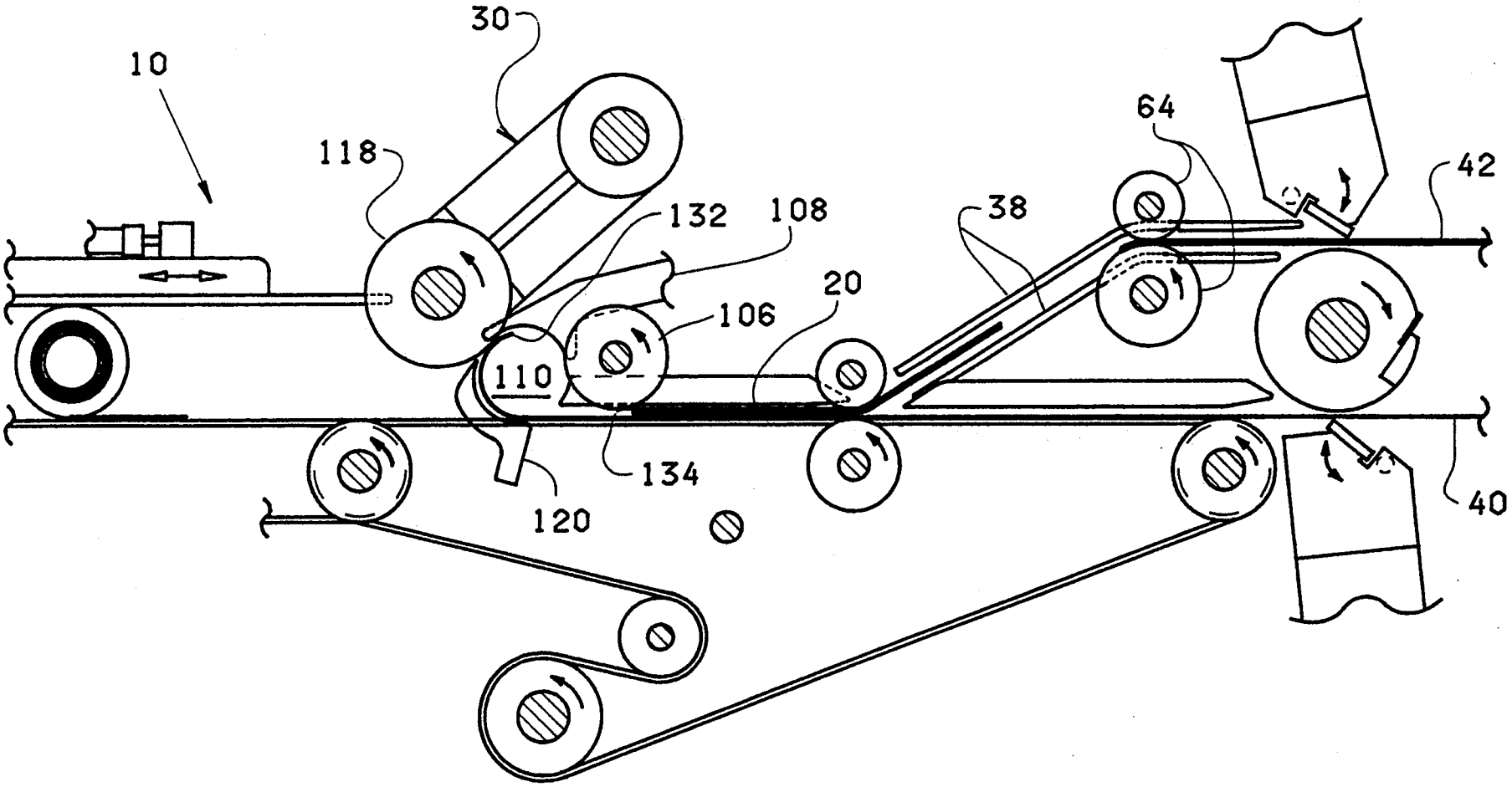
Figure 6:
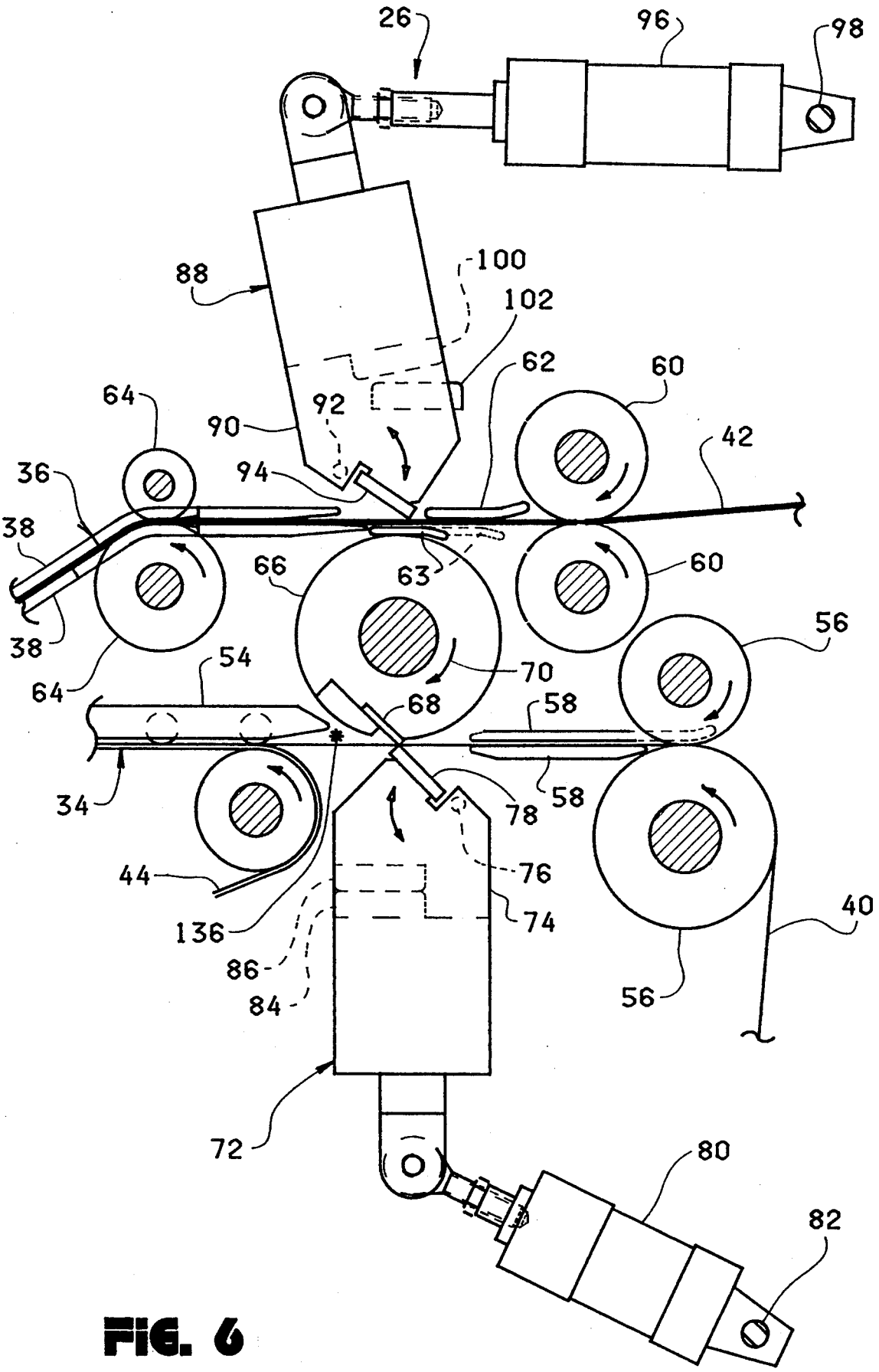
FIG. 6 is an enlarged view of a portion of the apparatus in the position shown in FIG. 5.

FIG. 5 illustrates cutting of moving web 40 by rotation of cutter roll 66 180 degrees after cutting of stationary web 42. Cutting of web 40 is accomplished by extending cylinder 80 to move anvil blade 78 to the extended position prior to rotation of the cutter blade from the position of FIG. 4 to the position of FIG. 5 in order to sever the downstream moving web 40. As previously mentioned, anvil blade 78 and cutter blades 68 are of helical design in order to assure that the rapidly downstream moving web 40 is cut perpendicularly. Anvil assembly 88 and anvil blade 94 are preferably rotated away from web 42 prior to cutting of web 40. Anvil assembly 72 and anvil blade 78 are rotated away from web 40 immediately after the web is cut as shown in FIG. 5. At this time, arms 112 continue to rotate upwardly to move rolls 118 above path 34. Cylinder 128 is extended to move the take away rails 126 upstream to engage the top of the partially wound spiral roll 12, thereby assuring rapid downstream rotation of the roll by the top runs of belts 44 and 52 as previously described. The downstream movement of the roll completely breaks the tabs at the previously formed cut in web 40 and separates the web at ends 130 and 132. Rotation of roll 12 onto the upper runs of belts 52 returns apparatus 10 to the position of FIG. 1, thereby completing a single cycle of operation.

In some cases when roll 12 is wound from thin web product paper 40, it may be desirable to provide a small rotary brush 136 extending across the upper surface of web 40 between the web cutting assembly 26 and the upstream end of product paper feed path 34 as illustrated in FIG. 6. The brush 136 is rotated in a clockwise direction so that the side of the brush facing the web moves in a downstream direction to assure that the severed web 40 is fed onto path 34 between adjacent hold down plate 54 and the upper runs of belts 44.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. Apparatus for winding a spiral paper roll having a stiffening layer, the apparatus comprising, A) product paper feed means for moving product paper from a source of product paper downstream along a product paper feed path;

B) web rolling means for forming a spiral roll from product paper fed downstream along the product paper feed path;

C) stiffening paper feed means for feeding stiffening paper from a source of stiffening paper downstream along a stiffening paper feed path, the stiffening paper feed path joining the product paper feed path upstream of the web rolling means; and D) a paper cutting assembly including, i. a cutter roll located between said feed paths, a cutter knife on the cutter roll, and drive means for rotating the cutter roll so that the cutter knife is rotated downstream along one path and upstream along the other path;

ii) a product paper anvil blade located on the side of the product paper feed path away from the cutter roll, said product paper feed path extending between the product paper anvil blade and the cutter roll; and iii) a stiffening paper anvil blade located on the side of the stiffening paper feed path away from the cutter roll, said stiffening paper feed path extending between the stiffening paper anvil blade and the cutter roll;

2. Apparatus as in claim 1 including,

E) first means for relatively moving said cutter knife and said product paper anvil blade, and relatively moving said cutter knife and said stiffening paper anvil blade to selectively sever product paper on the product paper feed path and stiffening paper on the stiffening paper feed path as the cutter knife is rotated past such paths.

3. Apparatus as in claim 2 wherein said drive means rotates the cutter roll to move the cutter knife downstream along the product paper feed path and upstream along the stiffening paper feed path.

4. Apparatus as in claim 3 wherein the cutter knife and the product paper anvil blade are curved and the stiffening paper anvil blade is straight.

5. Apparatus as in claim 4 including notches formed in the product paper anvil blade.

6. Apparatus as in claim 3 wherein the cutter knife is fixedly mounted on the cutter roll, the first means moves the product paper anvil blade toward and away from the cutter roll and moves the stiffening paper anvil blade toward and away from the cutter roll.

7. Apparatus as in claim 6 including a movable stiffening paper guide located adjacent the cutter roll and the stiffening paper anvil blade, and second means for moving the paper guide to a first position between the cutter roll and the stiffening paper anvil blade when the stiffening paper anvil blade is away from the cutter roll and moving the paper guide to a second position away from the cutter roll and the stiffening paper anvil blade when the stiffening paper anvil blade is adjacent the cutter roll.

8. Apparatus as in claim 3 wherein said product paper feed means includes a first pair of feed rollers located on opposite sides of the product paper feed path upstream of the cutter roll; and said stiffening paper feed means includes a second pair of feed rolls located on opposite sides of the stiffening paper feed path upstream of the cutter roll and a third pair of feed rolls located on opposite sides of the stiffening paper feed path downstream of the cutter roll.

9. Apparatus as in claim 8 including first paper guides on said product paper feed path between said first pair of rolls and the cutter roll and second paper guides on said stiffening paper feed paths located between said second pair of rolls and the cutter roll.

10. Apparatus as in claim 8 wherein said product paper feed means includes a friction belt engaging product paper on said product paper feed path between the cutter roll and the web rolling means.

11. Apparatus as in claim 10 including a drive for moving said friction belt downstream more rapidly than said first pair of feed rollers feeds product paper downstream.

12. Apparatus as in claim 10 including second means for biasing product paper on said product paper feed path against said friction belt.

13. Apparatus as in claim 10 including a fourth pair of feed rolls located at the junction between the product paper feed path and the stiffening paper feed path, such rolls feeding lengths of stiffening paper from the stiffening paper feed path onto the product paper feed path.

14. Apparatus as in claim 3 including a product paper anvil assembly, said assembly including a first anvil support, said product paper anvil blade being secured to said first support, a first pivot connection joining said first support to said apparatus and a first air cylinder for rotating said product paper anvil support to move the product paper anvil blade toward and away from the cutter roll; and a stiffening paper anvil assembly including a second anvil support, said stiffening paper anvil blade being secured to said second support, a second pivot connection joining said second support to said apparatus and a second air cylinder for rotating said stiffening paper anvil support to move the stiffening paper anvil blade toward and away from the cutter roll.

15. Apparatus as in claim 14 wherein the cutter knife and the paper anvil blade are curved.

16. Apparatus as in claim 14 wherein the stiffening paper anvil is straight and said stiffening paper feed means includes means for dwelling movement of the stiffening paper adjacent the cutter roll during cutting of the stiffening paper.

17. Apparatus as in claim 3 including rotary means located adjacent the product paper feed path and the cutter roll for guiding the severed end of product paper downstream along the product paper feed path.

18. Apparatus as in claim 17 wherein said rotary means comprises a rotary brush and a rotary brush drive for sweeping the brush downstream along the product paper feed path.

19. Apparatus for cutting spaced webs, said apparatus comprising,

A) a rotary cutter roll, a knife blade secured to and rotatable with the cutter roll, and drive means for rotating the cutter roll;

B) first means for feeding a first web of paper along a first path located on a first side of the cutter roll;

C) second means for feeding a second web of paper along a second path located on a second side of the cutter roll opposite from said first side;

D) a first anvil blade located on said first side of said cutter roll outside of the first path co-operable with said knife blade to sever a first web of paper on the first path when in a first web cutting position and rotation of the roll moves the knife blade past the first anvil blade, and third means for moving such first anvil blade toward and away from said first web cutting position; and E) a second anvil blade located on said second side of said cutter roll co-operable with said knife blade to sever a second web of paper on the second path when in a second web cutting position and rotation of the roll moves the knife blade past the second anvil blade, and fourth means for moving said second anvil blade toward and away from said second web cutting position.

20. Apparatus as in claim 19 wherein, and said drive means rotates the knife blade upstream along one path and downstream along the other path.

21. Apparatus as in claim 20 wherein said first and second path extend essentially parallel to each other and said first and second means feed said webs along said paths in the same direction past the cutter roll.

22. Apparatus as in claim 20 wherein the knife blade and said first anvil blade are curved and the rotary cutter moves the knife blade downstream along said first path.

23. Apparatus as in claim 22 wherein said second anvil blade is straight and said second means includes feed dwell means for dwelling a second web on the second path during cutting of such web by rotation of the knife blade past the second anvil blade.

24. Apparatus as in claims 22 including notches in said first anvil blade.

25. A roll wrapping apparatus an including apparatus as in claim 22 and roll winding means, said first path extending from the rotary cutter to the roll winding means, said second path joining said first path upstream of the roll winding means, whereby cut lengths of paper from first and second webs are fed to the roll winding means and are wound together into a roll.

26. The method of winding a stiffened paper roll from a length of product paper and a length of stiffening paper, comprising the steps of:

A) feeding a web of product paper from a source of product paper downstream along a first path to a cutter roll, the first path extending to a roll winding assembly;

B) feeding a web of stiffening paper from a source of stiffening paper downstream along a second path spaced a distance from the first path to a cutter roll, the second path extending to a junction with the first path;

C) continuously rotating a cutter roll located between said first and second paths to move a blade on the cutter roll upstream and downstream along said paths;

D) relatively moving a first anvil located on the side of the first path away from the cutter roll and the blade toward and away from each other so that the first anvil and blade cooperate to selectively sever a length of product paper from the product paper web;

E) relatively moving a second anvil located on the side of the second path away from the cutter roll and the blade toward and away from each other so that the second anvil and blade cooperate to selectively sever a length of stiffening paper from the stiffening paper web;

F) feeding the severed lengths of the product paper and the stiffening paper the said paths to the roll winding station; and G) winding the severed lengths together at the roll winding assembly to form a stiffened paper roll.

27. The method of claim 26 including the step of rotating the blade downstream along the first path.

28. The method of claim 27 including the step of providing a partial cut extending across the product web and completely breaking said cut during winding of the length of product paper into a roll.

29. The method of claim 27 including the step of winding the length of stiffening paper in the inner ,spiral portion of the roll.

30. The method of claim 27 including the step of forming a perpendicular cut across the product paper web.

31. The method of claim 30 including the step of dwelling the stiffening paper web during cutting.

32. The method of claim 31 including the step of forming a perpendicular cut across the stiffening paper web.

33. The method of claim 30 including the step of feeding each web downstream past the cutter roll.

* * * * *

UNITED STATES PATENT AND TRADEMARK OFFICE

CERTIFICATE OF CORRECTION

PATENT NO. : 5,344,091

DATED : September 6, 1994

INVENTOR(S) : Robert E. Molison

It is certified that error appears in the above-identified patent and that said Letters Patent is hereby corrected as shown below:

Column 2, line 23, delete "a a".

Claim 1, column 10, line 10, change ";" to --.--.

Claim 20, column 11, line 60, delete ", and".

Claim 21, column 11, line 64, change "path" to --paths--.

Claim 25, column 12, line 10, change "an including" to --including an--.

Claim 26, column 12, line 46, after "stiffening paper", insert --along--.

Signed and Sealed this

Fifteenth Day of November, 1994

*Attest:*

*Attesting Officer*

BRUCE LEHMAN

*Commissioner of Patents and Trademarks*